US008651234B2

(12) United States Patent
Yocco

(10) Patent No.: US 8,651,234 B2
(45) Date of Patent: Feb. 18, 2014

(54) HARNESS

(76) Inventor: Scott C. Yocco, Racine, WI (US)

( * ) Notice: Subject to any disclaimer, the term of this patent is extended or adjusted under 35 U.S.C. 154(b) by 0 days.

(21) Appl. No.: 13/472,875

(22) Filed: May 16, 2012

(65) Prior Publication Data

US 2012/0324706 A1 Dec. 27, 2012

Related U.S. Application Data

(63) Continuation-in-part of application No. 13/167,364, filed on Jun. 23, 2011.

(51) Int. Cl.
*A62B 35/00* (2006.01)

(52) U.S. Cl.
USPC ..... 182/3

(58) Field of Classification Search
USPC ..... 182/3, 6
See application file for complete search history.

(56) References Cited

U.S. PATENT DOCUMENTS

| | | | | | |
|---|---|---|---|---|---|
| 1,845,099 | A | | 2/1932 | Burianova | |
| 2,979,153 | A | * | 4/1961 | Hoagland et al. | 182/3 |
| 3,176,793 | A | * | 4/1965 | Hlacia | 182/3 |
| 3,701,395 | A | | 10/1972 | Theobald | |
| 3,973,643 | A | | 8/1976 | Hutchinson | |
| 4,177,877 | A | | 12/1979 | Gallinati | |
| 4,273,216 | A | | 6/1981 | Weissmann | |
| 4,449,253 | A | | 5/1984 | Hettinger | |
| 4,625,335 | A | | 12/1986 | Vinai | |
| 4,731,882 | A | | 3/1988 | Ekman | |
| 4,854,418 | A | | 8/1989 | Hengstenberger et al. | |
| 5,145,027 | A | * | 9/1992 | Petzl et al. | 182/3 |
| 5,203,829 | A | * | 4/1993 | Fisk et al. | 119/857 |
| 5,220,976 | A | | 6/1993 | Gunter | |
| 5,697,329 | A | * | 12/1997 | Bell et al. | 119/857 |
| 5,738,046 | A | | 4/1998 | Williams et al. | |
| 5,787,500 | A | | 8/1998 | Lobello | |
| 5,960,480 | A | | 10/1999 | Neustater et al. | |
| 5,970,517 | A | | 10/1999 | Jordan | |
| 6,101,631 | A | * | 8/2000 | Ferguson, Jr. | 2/94 |
| 6,128,782 | A | * | 10/2000 | Young et al. | 2/69 |
| 6,205,584 | B1 | | 3/2001 | Yocco | |
| RE37,394 | E | * | 10/2001 | Woodyard | 2/102 |
| 6,892,395 | B2 | * | 5/2005 | Schweer | 2/94 |
| 7,341,025 | B1 | * | 3/2008 | Streeter et al. | 119/857 |
| 8,002,082 | B2 | * | 8/2011 | Snedeker | 182/3 |
| 2007/0023231 | A1 | * | 2/2007 | Gorman et al. | 182/3 |
| 2008/0164095 | A1 | * | 7/2008 | Snedeker | 182/3 |
| 2010/0293696 | A1 | * | 11/2010 | Real et al. | 2/93 |

* cited by examiner

*Primary Examiner* — Katherine Mitchell
*Assistant Examiner* — Kristine Florio
(74) *Attorney, Agent, or Firm* — Boyle Fredrickson, S.C.

(57) ABSTRACT

A harness device and method are provided. The device includes a strap having first and second opposite ends. The strap defines first and second arm loop portions positionable about corresponding shoulders of the individual and being movable between a first open configuration allowing a corresponding shoulder to be positioned therein and a second configuration for capturing the corresponding shoulder to be positioned. The strap further defines first and second leg loop portions selectively receivable about legs of the wearer and adjustable via an adjustment mechanism to tighten the leg loop portions around the wearer's legs. A connection point is defined by the first and second ends of the. A belt is operatively connected to the strap and is positionable about a waist of the individual.

9 Claims, 3 Drawing Sheets

HARNESS

CROSS REFERENCE TO RELATED APPLICATIONS

This application is a continuation-in-part of U.S. patent application Ser. No. 13/167,364, filed on Jun. 23, 2011 and entitled Tether Device and Method, the entirety of which is hereby incorporated by reference thereto.

FIELD OF THE INVENTION

This invention relates generally to harnesses, and in particular, to a harness which may be used as a fall prevention device for tethering an individual to an anchor while the individual is in an elevated position, or alternatively, as a drag harness for allowing an individual who is incapacitated and wearing the harness to be dragged to safety by a third party.

BACKGROUND AND SUMMARY OF THE INVENTION

By way of background, hunters often seek elevated perches, such as tree stands, to gain an improved vantage point over the surrounding landscape while hunting. Such elevated tree stands are often accessed by way of a ladder, or by manually scaling the side of the tree in what is referred to as a climbing tree stand. Regardless of the style of tree stand utilized, the stands are similar in that they provide an elevated platform from which the hunter can survey the surrounding landscape while hunting. Once elevated, however, the hunter as at risk of falling out of the stand and becoming injured.

As is known, most traditional tree stands are intended to support a single hunter. Accordingly, if a hunter were to fall out of a tree stand and become injured, it is possible that no one would be in the immediate vicinity to provide the required first aid. Such risk of injury is further compounded by the fact that most hunting occurs in remote locations, far from populated areas where one might successfully call for required assistance. Additionally, falling from a tree stand may result in accidentally discharging a firearm or dislodging a sharpened blade such as a hunting knife or arrow, thereby further increasing the risk of physical injury.

Further, many tree stands incorporate safety measures such as a seatbelt or a restraining line to limit the occurrence of such falls. However, these many of these safety measures are integrated into the tree stand, such that if the tree stand were to disengage from the tree and fall, the safety measure would not arrest the hunter's fall. In addition, some of these safety measures, namely seatbelts, can limit the hunter's mobility and thereby inhibit the hunter's effectiveness. Also, many of these safety measures are incompatible with the bulky clothing necessary for hunting in cold weather climates.

Alternatively, it can be appreciated that laborers, such as construction workers, are often required to work at elevated locations. Typically, these laborers climb or are otherwise lifted to an elevated location. For example, such laborers may be positioned on a girder or similar structural element while working at a job site such as a skyscraper or other large building. These laborers are understandably at an increased risk of injury from falling, and therefore, typically employ some sort of safety measures such as a harness for preventing their fall. However, heretofore known safety measure suffer from a number of known disadvantages. For example, known harnesses tend to be relatively bulky and impede the wearer's movement. Thus, such harnesses render the laborers work more difficult and cumbersome. As a result, some laborers forego wearing the harnesses altogether, which understandably serves to increase the risk of injury thereto.

Moreover, in circumstances wherein an individual becomes incapacitated, removing the individual from a hazardous environment may be quite difficult. By way of example, firemen and persons are often engaged in rescue and clean-up operations at hazardous locales. If the individual becomes injured or is overcome by fumes or the like, the individual is dependent on others to effectuate a rescue. In order to rescue the incapacitated person, a third party will often grab the clothing of the incapacitated individual and drag the individual to safety. If the incapacitated individual is significantly larger than the rescuer, it may be difficult for the rescuer to carry or drag the incapacitated individual to safety. In addition, it is often times too difficult to grasp clothing of the incapacitated individual to drag such person to safety. Further, since clothing, such as a fireman's coat, is not secured to the incapacitated individual, it may be possible to inadvertently remove the coat from the incapacitated individual during the dragging of such person to safety. As a result, the fireman's coat must be repositioned on the incapacitated individual to prevent further injury to the incapacitated individual due to potential burning debris on the floor surface through which the incapacitated individual is dragged. This, in turn, increases the time required to remove the incapacitated individual from the hazardous environment.

Therefore, it is a primary object and feature of the present invention to provide a harness which may securely tether an individual to an anchor while the individual is in an elevated position.

It is a further object and feature of the present invention to provide a harness including a lower body harness adapted to enable the secure dragging or other such moving of the wearer from one location to another.

In accordance with the present invention, a harness device for a wearer is provided. The device includes a strap having first and second opposite ends. The strap defines first and second arm loop portions positionable about corresponding shoulders of the wearer. The first and second arm loop portions are movable between a first open configuration allowing a corresponding shoulder to be positioned therein and a second secured configuration for capturing the corresponding shoulder positioned therein. The strap also defines first and second leg loop portions positionable about the wearers legs and similarly movable between a first open configuration allowing a corresponding leg to be positioned therein and a second secured configuration for capturing the leg to be positioned therein. The leg loop portions may be adjusted via an adjustment mechanism to selectively tighten or loosen the leg loop portions about the wearer's legs.

A point is defined by the first and second ends of the strap. The point is connectable to an anchor. A belt is operatively connected to the strap and is positionable about a waist of the wearer. The belt includes first and second ends.

The strap includes a cross strap portion interconnecting the first and second arm loop portions and a connection structure connects the first and second ends of the strap to form the point. A fastening mechanism is operatively connected to the first and second ends of the belt. The fastening mechanism is moveable between an open configuration wherein the first and second ends of the belt are disconnected and a second closed position wherein the first and second ends of the belt are interconnected.

In accordance with a still further aspect of the present invention, a method is provided of tethering an individual to an elevated anchor. The method includes the step of placing a harness on an individual. The harness includes a strap having a first end and a second end. A belt is affixed around a waist of the individual. The belt is operatively connected to the strap. The first and second ends of the strap are interconnected to the elevated anchor.

The step of placing the harness on the individual includes the additional steps of forming first and second arm loops from the strap and positioning the first and second arm loops over corresponding shoulders of the individual and forming first and second leg loops from the strap and positioning the first and second leg loops over the wearer's legs.

If the individual is displaced from an elevated location, the first and second arm loops are constricted around the shoulders and the first and second leg loops are constricted around the legs of the individual so as to prevent the falling of the individual from the elevated location. The method may also include the additional step of incorporating the harness into a coat prior to the step of placing the harness on an individual.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
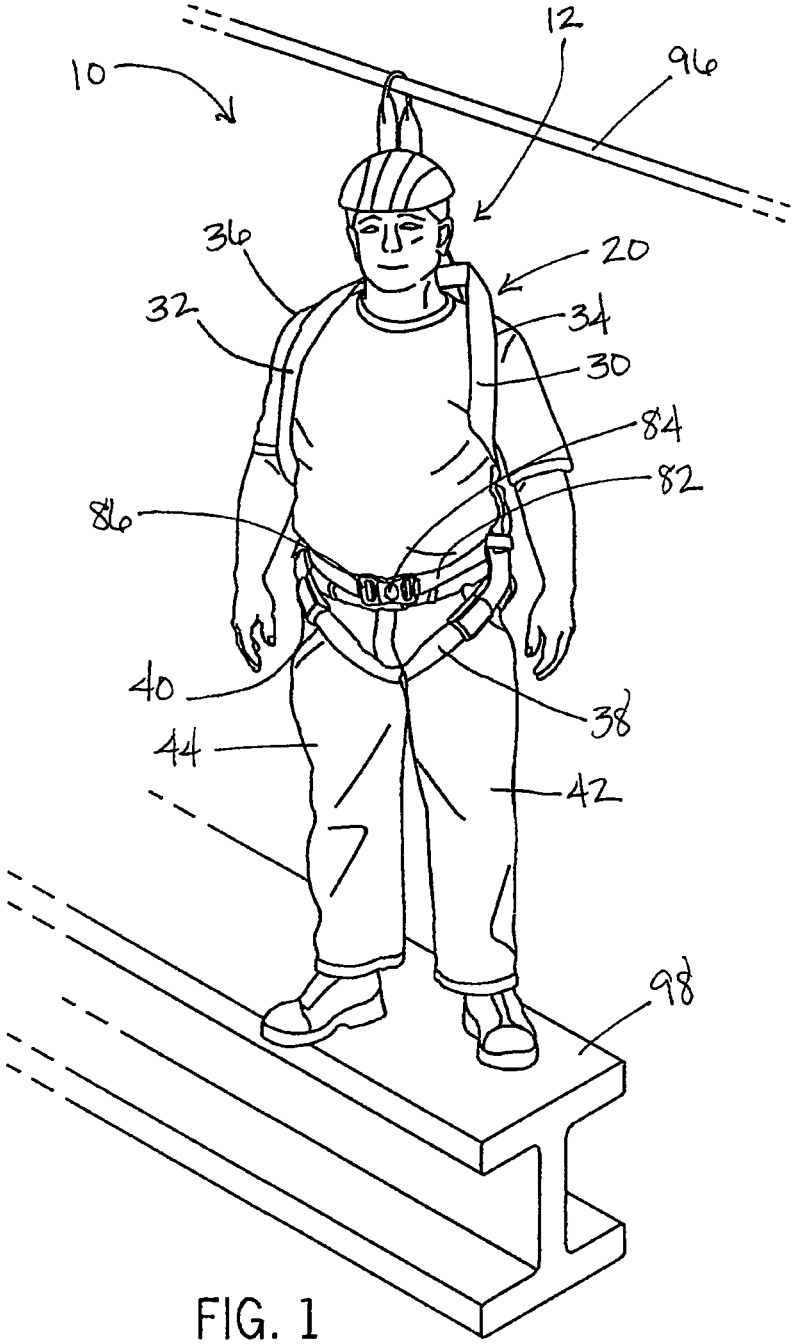
FIG. 1 is an isometric view of a harness in accordance with the present invention worn by an individual.
Figure 2:
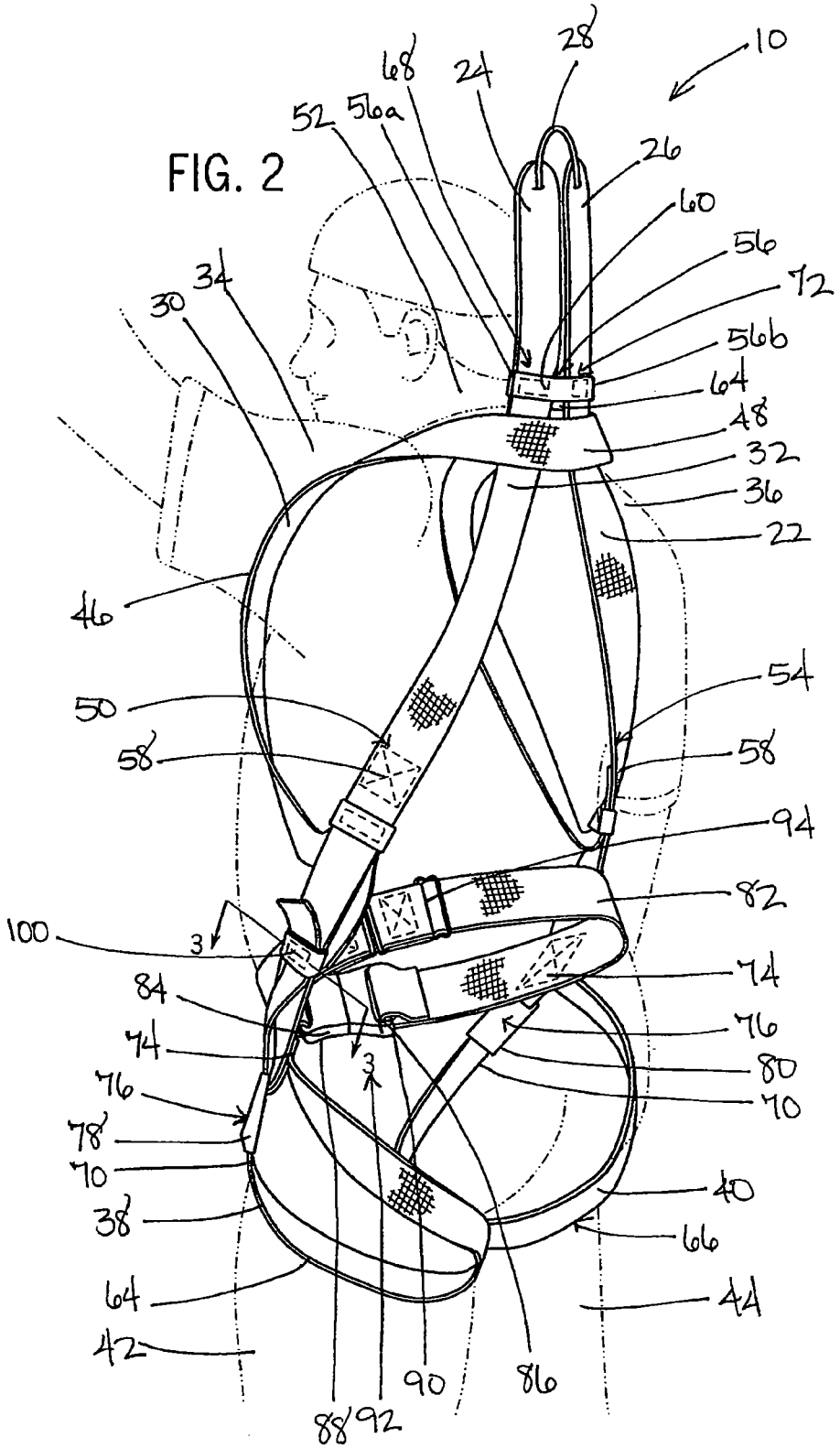
FIG. 2 is an isometric view of the harness of the present invention worn by an individual.
Figure 3:
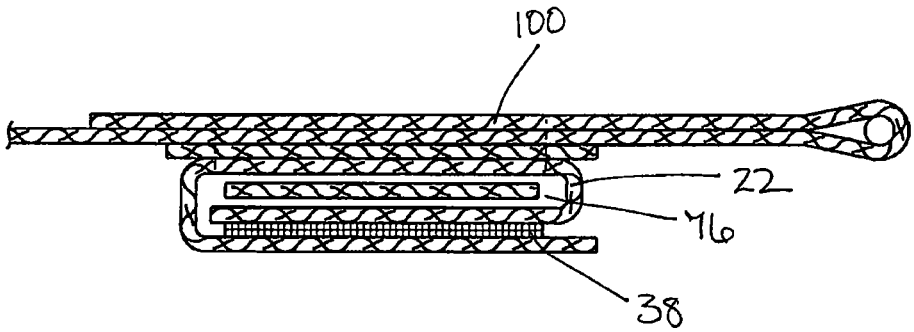
FIG. 3 is a cross-sectional view of the harness of the present invention taken along line 3-3 of FIG. 2.

Referring to FIGS. 1-3, a harness in accordance with the present invention is generally designated by the numeral 10. By way of example, it is contemplated for the harness 10 to be incorporated into a garment such as, for example, a coat (not shown). However, it can be appreciated that the harness 10 may be incorporated into other types of clothing such as fireman's jacket, without deviating from the scope of the present invention. Alternatively, as best seen in FIGS. 1-3, it can be appreciated that the harness 10 may be worn by an individual without being incorporated into a coat or other article of clothing.

Harness 10 includes an elongated, flexible strap 22 formed from a single piece of webbed material or the like. The strap 22 terminates at first and second ends 24 and 26, respectively, which are joined together by sewing, permanent or releasable fasteners, or the like at a connection point 28 to form a single, continuous loop. The strap 22 includes a first arm loop 30 and a second arm loop 32, which are adapted to be received over corresponding shoulders 34 and 36 and a first leg loop 38 and a second leg loop 40, which are adapted to be received over corresponding legs 42 and 44.

The first and second arm loops 30 and 32 may be integrally formed from the strap 22 or may be attached thereto by any suitable manner such as stitching, adhesive, or the like. As illustrated, the arm loops 30 and 32 are defined by arm straps 46 having opposite ends 50 and 54 respectively that are stitched to the strap 22 at opposing connection points 58 and therewith define the arm loops 30 and 32. In the alternative, the arm straps 46 may comprise two separate pieces of webbed material wherein one end of each of the arm straps 46 may be attached to the strap 22 as discussed and wherein the other end of each of the arm straps 46 may be joined with the other, corresponding end of the opposite arm strap. The first and second leg loops 38 and 40 may be similarly constructed. As illustrated, the leg loops 38 and 40 are defined by leg straps 64 and 66, respectively. Each of the leg straps 64 and 66 includes a pair of opposite ends 72 and 74. One of the opposite ends 72 and 74 may be attached to the strap 22 in a manner similar to arm strap 46 and the other of opposite ends 72 and 74 may be fixedly coupled to a connector coupled with the strap 22 to thereby define the leg loops 38 and 40, as will be described in further detail herein.

The first and second arm loops 30 and 32 are respectively interconnected by a cross portion 48, which generally passes behind the neck 52 of the wearer or individual 11. A guide 56 may be provided and includes first and second opposing ends **56*a* and 56*b*, respectively, and includes an inner face (not shown) and an outer face 60. The guide 56 is interconnected at the first and second opposing ends 56*a* and 56*b* respectively at an intermediate location to the interior surface of the cross portion 48 of the strap 22 so as to define first and second passageways 68 and 70 respectively. It is intended for the first and second ends 24 and 26, respectively, of the strap 22 to be slidably received in the corresponding first and second passageways 68 and 70**, respectively.

The first and second leg loops 38 and 40, respectively, are interconnected with the strap 22 by sewing, permanent or releasable fasteners or the like at a connection point 76. Each of the first and second leg loops 38 and 40, respectively, may include a respective adjustment mechanism 78 and 80. Each of the adjustment mechanisms 78 and 80 may be generally configured to securely tighten the respective first and second leg loops 38 and 40 around the respective leg 42 and 44. In particular, each of the adjustment mechanisms 78 and 80 may include a buckle of the kind generally known in the art through which the strap 22 defining the first and second leg loops 38 and 40 may be received in a serpentine manner to provide a selectively adjustable fastener for tightening the connection of the first and second leg loops 38 and 40, respectively, around the respective legs 42 and 44 of the wearer 12. The first and second leg loops 38 and 40, respectively, may also include respective retention members 100 for securing an excess portion of strap 22.

A belt 82 includes a first end 84 and a second end 86 opposite the first end 84 and is configured to be received around the waist of the wearer 12. The first end 84 of the belt 82 includes a male connector 88 adapted for selectively matingly engaging a female connector 90 interconnected to the second end 86 of the belt 82. The male connector 88 and the female connector 90 define a mated fastening mechanism 92 providing the wearer 12 with a simple structure for securing the harness 10 to the wearer 12. It is contemplated to provide the belt 82 with at least one adjustment mechanism 94 along the length thereof to allow the wearer 12 to adjust the overall length of the fastening mechanism 92 and/or adjustment mechanism may be used to interconnect the first and second end 84 and 86, respectively, of the belt 82 and adjust the length thereof without deviating from the scope of the present invention.

In operation, the wearer 12 puts the harness 10 on in a conventional manner such that the first and second arm loops 30 and 32 are received over the corresponding shoulders 34 and 36, respectively, of the wearer 12. The wearer 12 may then secure the first and second leg loops 38 and 40 over the respective legs 42 and 44. The first and second ends 84 and 86 of the belt 82 may then be brought into mating relationship with one another around the waist of the wearer 12 in a conventional manner. The length of the belt 82 may be adjusted via the adjustment mechanism 94 as is generally understood to secure the belt 82 snugly around the waist of the wearer 12.

Thereafter, once the wearer 12 has moved to a desired, elevated position, the connection point 28 of the harness 10 can be secured to an elevated anchor, e.g., girder 96 suitable for arresting the fall and supporting the weight of the wearer 12, FIG. 1. With connection point 28 tethered to an anchor, such as a support, it can be appreciated that the harness 10 does not inhibit the wearer's 12 range of motion, mobility or flexibility as required of construction working, hunting, firefighting, etc. Further, it is noted that no significant force is exerted upon the connection point 28 as the weight of the individual is distributed over the support structure supporting the wearer 12, e.g., beam 98.

In the event that the wearer 12 should fall from or otherwise become displaced from the elevated support structure, e.g., beam 98, gravity pulls the wearer 12 downwardly so as to exert a force on the connection point 28 and tighten the first and second arm loops 30 and 32, respectively, about shoulders 34 and 36, respectively, of the wearer 12. With the first and second arm loops 30 and 32, respectively, tightened about the shoulders 34 and 36, respectively, of the wearer 12, the wearer 12 is retained within the harness 10. As such, the individual is suspended from the connection point 28 by the strap 22 of the harness 10 in an elevated position, thereby preventing the individual from falling to the ground and becoming injured. It is intended for a portion of the weight of the wearer 12 to be partially distributed along the belt 82 of the harness 10 and the first and second leg loops 38 and 40.

As previously described, the harness 10 according to the present invention may additionally be used to assist in moving the wearer 12 from one location to another. Thus, in operation, should the wearer 12 of the harness 10 become unconscious or otherwise be incapacitated such that the wearer 12 is unable to move, another individual may be able to relatively easily drag the wearer 12 from the wearer's 12 current location to another location. For example, in the case of a firefighter wearing the harness 10 becoming unconscious due to inhalation of smoke or other such scenario, a fellow firefighter may be able to move the wearer 12 by dragging the wearer 12. In operation, the individual responding to the incapacitated wearer 12, may grasp the harness 10 by the connection point 28 such that first and second arm loops 30 and 32, respectively, tighten about shoulders 34 and 36, respectively, of the wearer 12. With the first and second arm loops 30 and 32, respectively, tightened about the shoulders 34 and 36, respectively, of the wearer 12, the individual responding to the incapacitated wearer 12 may pull/drag the wearer 12 to safety. The first and second leg loops 38 and 40, respectively, received around the wearer's 12 legs 42 and 44, respectively, provide means for distributing the weight of the wearer 12 across the harness 10 to make movement of the individual relatively easier. Moreover, as the first leg and second loops 38 and 40, respectively, are received around the legs 42 and 44, respectively, the harness 10 is positioned about a lower portion of the wearer 12 so as to make movement of the wearer's 12 lower portion relatively easier.

Various modes of carrying out the invention are contemplated as being within the scope of the following claims particularly pointing out and distinctly claiming the subject matter which is regarded as the invention.

I claim:

1. A harness device for a wearer, the wearer having shoulders and legs, comprising:

a strap having first and second opposite ends and including first and second strap portions, each strap portion having connection ends intermediate of the first and second ends of the strap;

an arm strap having first and second ends connected to the strap and defining first and second arm loop portions positionable about corresponding shoulders of the wearer, the first and second arm loop portions being movable between a first open configuration allowing a corresponding shoulder to be positioned therein and a second configuration for capturing the corresponding shoulder positioned therein, and wherein the arm strap includes a cross strap portion interconnecting the first and second arm loop portions;

a connection point defined by the connection ends of the first and second strap portions joined together;

a first leg strap defining a first leg loop portion positionable about a first leg of the wearer and being movable between a first open configuration allowing the first leg to be positioned therein and a second configuration for capturing the first leg positioned therein, the first leg strap having a first leg strap first end interconnected to the strap at a location adjacent the strap first end thereof and a first leg strap second end;

a second leg strap defining a second leg loop portion positionable about a second leg of the wearer and being movable between a first open configuration allowing the second leg to be positioned therein and a second configuration for capturing the second leg positioned therein, the second leg strap having a second leg strap first end interconnected to the strap at a location adjacent the strap second end thereof and a second leg strap second end;

a belt operatively connected to the strap and being positionable about a waist of the wearer, the belt includes first and second ends;

a first adjustment mechanism for coupling the first end of the strap to the second end of the first leg strap, wherein the first adjustment mechanism is configured to selectively tighten the first leg loop portion around and release the first leg of the wearer; and a second adjustment mechanism for coupling the second end of the strap to the second end of the second leg strap, wherein the second adjustment mechanism is configured to selectively tighten the second leg loop portion around and release the second leg of the wearer.

2. The device claim 1 further comprising a connection structure, for connecting the connection ends of the first and second strap portions to form the connection point.

3. The device of claim 1 further comprising a fastening mechanism operatively connected to the first and second ends of the belt, the fastening mechanism moveable between an open configuration wherein the first and second ends of the belt are disconnected and a second closed position wherein the first and second ends of the belt are interconnected.

4. The device of claim further comprising a guide operatively connected to the strap, the guide defining at least one passageway for receiving the first and second ends of the strap therethrough.

5. The device of claim 1, wherein the first and second adjustment mechanisms include buckle members for receiving portions of the first and second leg straps therethrough to provide means for tightening the first and second leg loop portions around the respective first and second legs.

6. A harness device for a wearer, the wearer having shoulders, comprising:

a strap having first and second opposite ends and including first and second strap portions, each strap portion having connection ends intermediate of the first and second ends of the strap;

an arm strap having first and second ends connected to the strap and defining first and second arm loop portions positionable about corresponding shoulders of the wearer, the first and second arm loop portions being movable between a first open configuration allowing a corresponding shoulder to be positioned therein and a second configuration for capturing the corresponding shoulder, and wherein the arm strap includes a cross strap portion interconnecting the first and second arm loop portions;

a connection point defined by connection ends of the first and second strap portions;

a first leg strap defining a first leg loop portion portions positionable about a first leg of the wearer and being movable between a first open configuration allowing the first leg to be received therein and a second configuration for capturing the first leg, the first leg strap having a first leg strap first end interconnected to the strap at a location adjacent the strap first end thereof and a first leg strap second end;

a second les strap defining a second leg loop portion positionable about a second leg of the wearer and being movable between a first open configuration allowing the second leg to be positioned therein and a second configuration for capturing he second leg positioned therein, the second leg strap having a second leg strap first end interconnected to the strap at a location adjacent the strap second end thereof and a second leg strap second end;

a first adjustment mechanism for coupling the first end of the strap to the second, end of the first leg strap, wherein the first adjustment mechanism is configured to selectively tighten the second leg loop portion around and release the first leg of the wearer; and a second adjustment mechanism for coupling the second end of the strap to the second end of the second leg strap, wherein the second adjustment mechanism is configured to selectively tighten the second leg loop portion around and release the second leg of the wearer.

7. The device claim 6 further comprising a connection structure for connecting the connection ends of the first and second strap portions to form the connection point.

8. The device of claim 6 further comprising:

a belt operatively connected to the strap and being positionable about a waist of the wearer, the belt includes first, and second ends; and a fastening mechanism operatively connected to the first and second ends of the belt, the fastening mechanism moveable between an open configuration wherein the first and second ends of the belt are disconnected and a second closed position wherein the first and second ends of the belt are interconnected.

9. The device of claim 6 further comprising a guide operatively connected to the strap, the guide defining at least one passageway for receiving the first and second ends of the strap therethrough.

* * * * *